US006247458B1

(12) United States Patent
Heinemann et al.

(10) Patent No.: US 6,247,458 B1
(45) Date of Patent: Jun. 19, 2001

(54) TANK VENTING DEVICE FOR MOTOR VEHICLES

(75) Inventors: Joachim Heinemann, Gorxheimertal; Uwe Fiedler, Reilingen; Uwe Meinig, Weinheim, all of (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/350,019

(22) Filed: Jul. 9, 1999

(30) Foreign Application Priority Data

Jul. 11, 1998 (DE) ..... 198 31 188

(51) Int. Cl.[7] ..... F02M 37/04
(52) U.S. Cl. ..... 123/520; 123/516
(58) Field of Search ..... 123/520, 521, 123/519, 518, 516, 494, 198 D

(56) References Cited

U.S. PATENT DOCUMENTS 5,245,975 * 9/1993 Ito ..... 123/520
5,349,935 * 9/1994 Mezger et al. ..... 123/520
5,390,645 * 2/1995 Cook et al. ..... 123/520
5,483,942 * 1/1996 Perry et al. ..... 123/520
5,499,614 * 3/1996 Busato et al. ..... 123/520
5,715,799 * 2/1998 Blomquist et al. ..... 123/520
5,881,700 * 3/1999 Gras et al. ..... 123/520

FOREIGN PATENT DOCUMENTS 196 39 116 3/1998 (DE) .

* cited by examiner

*Primary Examiner*—Carl S. Miller
(74) *Attorney, Agent, or Firm*—Kenyon & Kenyon

(57) ABSTRACT

A tank venting device for motor vehicles having a fuel tank, an adsorption filter connected thereto that receives the fuel vapors, an air inlet valve, and a regeneration line to the engine in which an air delivery pump is arranged. A regeneration valve controlled by the engine is provided in the regeneration line before the air delivery pump in order to control the regeneration flow rate.

5 Claims, 2 Drawing Sheets

TANK VENTING DEVICE FOR MOTOR VEHICLES

BACKGROUND OF THE INVENTION

In the field of vehicle engines, ways are constantly being sought, in the interest of the environment, to minimize the emissions that occur. Exhaust gas treatment alone is no longer sufficient for the demands now being made; the emergence of low-boiling fuel components from the fuel tank also needs to be prevented if at all possible. Sealed tank venting devices in which the fuel vapors emerging from the fuel tank are conveyed, via a venting line, to an adsorption filter have therefore been introduced. Since the activated carbon of the filter possesses only limited storage capability, the filter must be flushed with ambient air and the fuel vapors must be conveyed to the engine for combustion. The fuel vapors must be conveyed in defined quantities.

In carbureted engines or gasoline engines with intake duct injection, the fuel vapor is delivered by way of the vacuum produced in the intake duct of the carburetor. This method is not possible to the desired extent, however, in direct-injection engines, which yield considerable fuel saving. But there are difficulties with turbocharged gasoline engines as well, since in significant portions of the characteristics diagram the pressure in the intake duct is positive with respect to the atmosphere. Ways have therefore been sought to improve the flushing mass flow.

German Unexamined Application 196 39 116 discloses a tank venting device for motor vehicles in which an air delivery pump is used for the regeneration quantity. A device of this kind is independent of the vacuum in the intake duct of the engine. The air delivery pump is operated at variable rotation speed as a metering pump. It can also be used as a diagnosis pump in order to detect leaks. A device of this kind is relatively sluggish, however, since there is a long delay in the pump's reaction to changes in engine output.

SUMMARY OF THE INVENTION

An object of the present invention is the creation of a tank venting device in which the regeneration flow rate is independent of pressure conditions in the engine region, which in addition ensures the predefined regeneration flow rate both at full load and when the engine is idling, and which moreover reacts without delay to changes in engine output. The regeneration flow rate is to be controlled in proportion to the engine mass flow rate.

The aforesaid object is achieved in a tank venting device for motor vehicles having a fuel tank, an adsorption filter attached thereto that receives the fuel vapors and has a closable air inlet, and which has a regeneration line to the engine in which an air delivery pump is arranged, by the provision of a regeneration valve controlled by the engine controller in the regeneration line before the air delivery pump in order to regulate the regeneration flow rate. It has been found in tests that this arrangement of regeneration valve and air delivery pump yields surprisingly good results.

It is advantageous that when the engine is stopped, the device is closed by the regeneration valve. The respective maximum regeneration volume is reached when the engine is at full load and also part load. The necessary vacuum in the activated carbon filter is maintained at every engine output level.

Regeneration valves for the control of regeneration quantities are known per se. In most cases they control the regeneration quantities by timed, pulse-width modulated activation as a function of engine output in engines in which a vacuum is present in the intake duct. Their use in conjunction with an air delivery pump, specifically on the intake side before the pump, yields surprisingly good results in the metering of the regeneration quantities, regardless of the pressure present in the engine's fuel delivery system.

The air delivery pump can be driven both electrically and mechanically. It is pilot-controlled by the regeneration valve. The particular advantages of the tank venting device can be achieved by way of this combination of air delivery pump and regeneration valve. The delivery output of the air delivery pump can thus be approximately constant over broad ranges of differential pressure.

To ensure that the tank venting device can also be utilized in leak diagnosis, the air delivery valve is equipped with a switchover valve to reverse the delivery direction. As is already known per se from the aforementioned document, this results in a pressure buildup in the system and allows leakage measurement. To prevent any impermissible excess pressure from being caused, however, a pressure relief valve is arranged between the intake and discharge fittings of the air delivery pump.

Advantageously, the air delivery pump, the switchover valve, the pressure relief valve, and the regeneration valve are combined into one module.

The module is mounted as close as possible to the engine block so that the requisite lines between pump and intake duct can be kept as short as possible.

To assist in leak diagnosis and also to improve the determination of the tank fill level, a connectable throttling element, having a defined outlet opening, is provided between the fuel tank and the regeneration valve, preferably on the adsorption filter. When connected, the throttling element allows a simulated pressure drop. By performing the leak diagnosis with and without the throttling element connected, a test can be performed by comparing the results. The fill level can be calculated from the time difference.

The air delivery pump and the valves are involved in performance of the leak diagnosis. Once the delivery direction of the air delivery pump has been changed by activating the switchover valve with the regeneration valve open, the pressure in the tank venting device is elevated to a predefined diagnosis pressure. A pressure sensor on the fuel tank then causes the regeneration valve to close, and the leakage rate can be ascertained with the diagnostic device. To check and equalize the results, the above procedure can be repeated with the throttling element connected.

The invention will be explained in more detail with reference to two exemplary embodiments.

DETAILED DESCRIPTION

Figure 1:
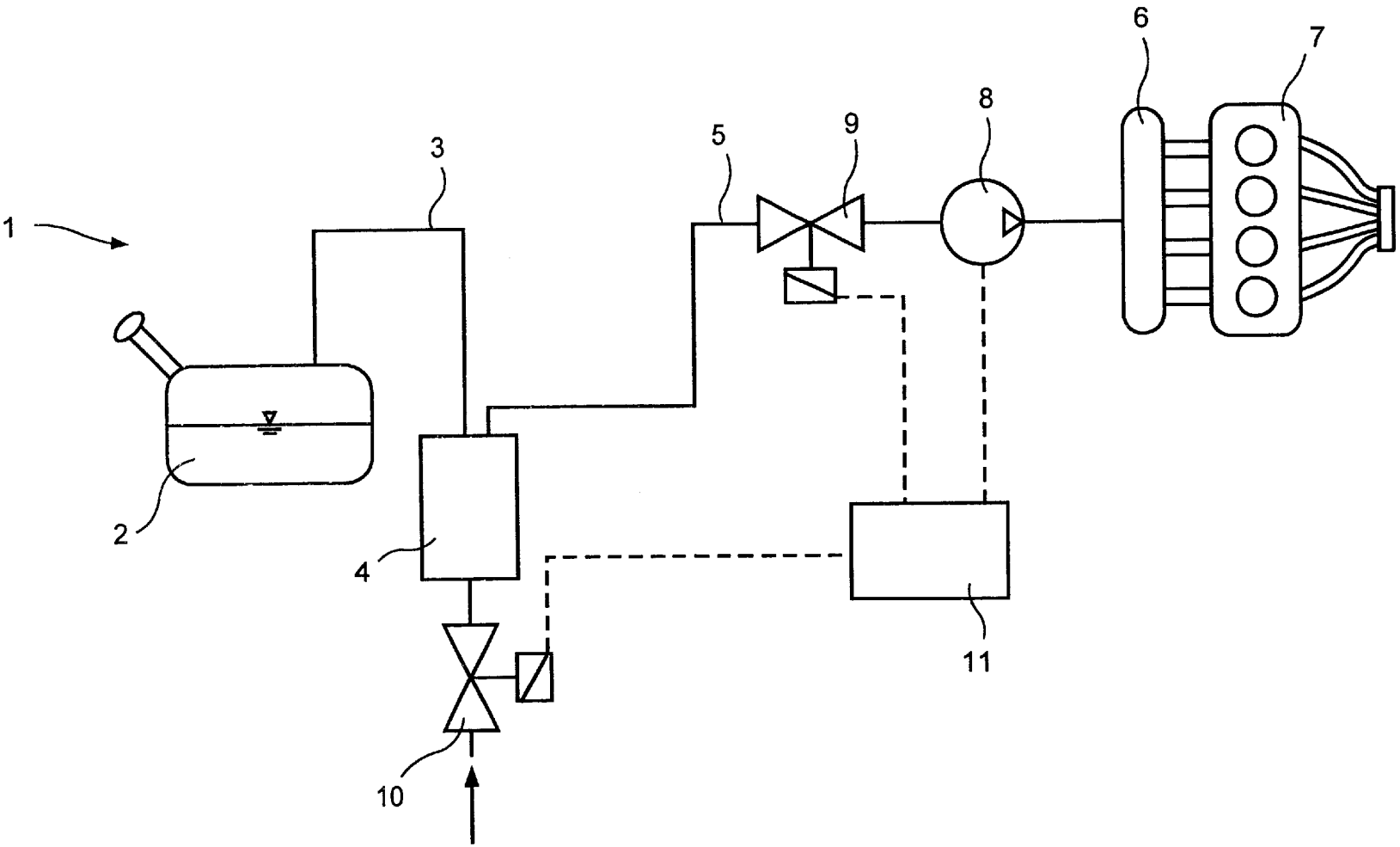
FIG. 1 is a schematic depiction of a first embodiment of a tank venting device constructed according to the principles of the invention, seen to have an air delivery pump and a regeneration valve.

FIG. 1 shows the general configuration of a tank venting device 1 according to the present invention. Fuel tank 2 has a vent line 3 through which fuel vapors are conveyed to adsorption filter 4. Adsorption filter 4 is equipped with activated carbon on which the hydrocarbon vapors are deposited. Connected to adsorption filter 4 is regeneration line 5, which opens into intake duct 6 of carbureted engine 7. Air delivery pump 8 and regeneration valve 9 are inserted into regeneration line 5.

Air delivery pump 8, regeneration valve 9, and air inlet valve 10 are controlled by engine control device 11 as a function of engine output. For the regeneration operation, upon startup of engine 7, air inlet valve 10 is opened and air delivery pump 8 begins to deliver. The delivery volume of air delivery pump 8 is regulated by regeneration valve 9, which is activated by engine control device 11.

Figure 2:
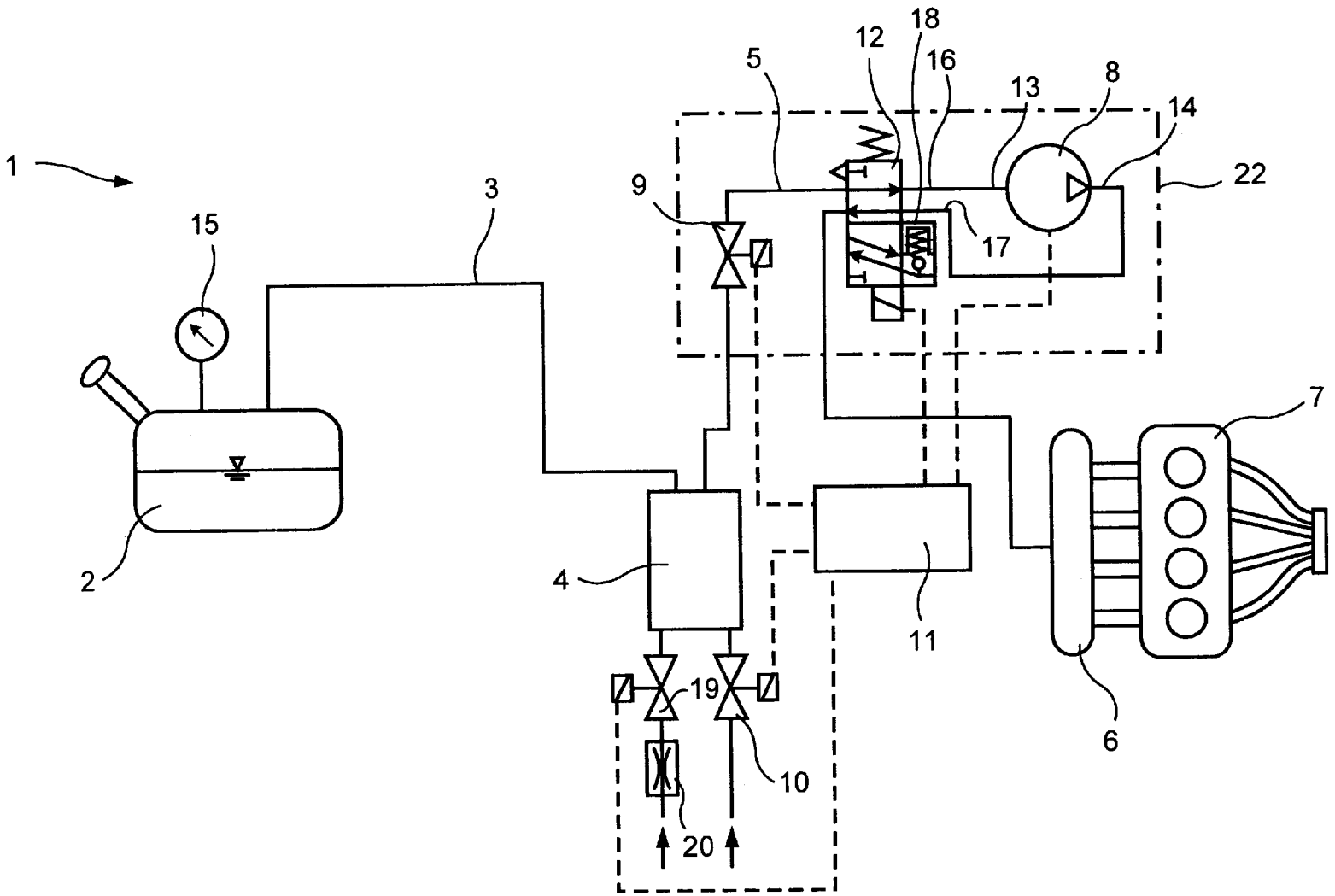
FIG. 2 is a schematic depiction of a second embodiment of a tank venting device constructed according to the principles of the invention, with a module made up of an air delivery pump, regeneration valve, switchover valve, and pressure relief valve.

FIG. 2 schematically shows an embodiment of the invention with which onboard diagnosis can also be performed. For this purpose, switchover valve 12 is additionally used to reverse the delivery direction. Air delivery pump 8 is connected with its inlet 13 and its outlet 14 to switchover valve 12. After the switchover, air is drawn in from the atmosphere and, with regeneration valve 9 open, delivered into regeneration line 5 toward adsorption filter 4 and fuel tank 2. Air inlet valve 10 is closed. In order on the one hand to prevent excessive pressure in fuel tank 2 and in other parts of the device, and on the other hand to allow leak diagnosis to be implemented, fuel tank 2 is equipped with pressure sensor 15. Once the predefined diagnosis pressure has been reached, regeneration valve 9 is closed and any pressure drop is measured. Additionally arranged between intake fitting 16 and discharge fitting 17 of air delivery pump 8 is a pressure relief valve 18 that, in the event of excessive pressure, creates a bypass and short-circuits pump 8. To allow the tank fill level to be ascertained exactly and also to allow a very accurate leakage test to be performed, a throttling element 20 with a defined outlet opening, which can be connected via shutoff valve 19, is provided between fuel tank 2 and regeneration valve 9. In the present embodiment, shutoff valve 19 along with throttling element 20 is connected to adsorption filter 4. As described above, the diagnosis operation takes place initially with shutoff valve 19 closed, and is then repeated, after pressure has been built up again, with shutoff valve 19 open. The tank fill level can be calculated from the time difference between the tests with throttling element 20 closed and open. Air delivery pump 8, switchover valve 12, regeneration valve 9, and shutoff valves 10 and 19 are controlled via engine control device 11. The dashed lines indicate the corresponding connector cables. For practical use, provision is made for air delivery pump 8, switchover valve 12 with pressure relief valve 18, and regeneration valve 9 to be combined into one module 22. This module can be mounted replaceably in the tank venting device directly on engine 7. Its parts are enclosed by the rectangle indicated in broken lines.

What is claimed is:

1. A tank venting device for motor vehicles having a fuel tank, comprising:

an adsorption filter connected to a fuel tank via a vent line, wherein the adsorption filter receives fuel vapors through the vent line;

an air inlet valve connected to the adsorption filter;

a regeneration line linked to an engine along which an air delivery pump is arranged;

a regeneration valve, controlled by the engine, located along the regeneration line at a position prior to the air delivery pump in order to control the regeneration flow rate, wherein a connectable throttle element with a defined outlet opening is provided between the fuel tank and the regeneration valve for determining the tank fill level.

2. The tank venting device as defined in claim 1 wherein air delivery volume, controlled by the engine, provided by the air delivery pump is approximately constant over large regions of differential pressure in the regeneration line.

3. The tank venting device as defined in claim 1 wherein the air delivery pump has an inlet and an outlet and is connected at its inlet and at its outlet to a switchover valve for reversing air delivery direction.

4. The tank venting device as defined in claim 2, wherein the air delivery pump has an inlet and an outlet and is connected at its inlet and at its outlet to a switchover valve for reversing air delivery direction.

5. The tank venting device as defined in claim 1, wherein the air delivery pump has intake and delivery fittings, and wherein a pressure relief valve is arranged between the intake and delivery fittings of the air delivery pump.

* * * * *